United States Patent [19]

Geyer

[11] 4,173,056

[45] Nov. 6, 1979

[54] SCRUBBING MACHINE WITH TRACKING SQUEEGEE

[75] Inventor: Robert A. Geyer, Anoka, Minn.

[73] Assignee: Tennant Company, Minneapolis, Minn.

[21] Appl. No.: 918,771

[22] Filed: Jun. 26, 1978

[51] Int. Cl.[2] ..... A47L 11/283; A47L 11/293; A47L 11/30

[52] U.S. Cl. ..... 15/320; 15/401

[58] Field of Search ..... 15/50 C, 50 R, 320, 15/353, 401

[56] References Cited

U.S. PATENT DOCUMENTS

| | | | |
|---|---|---|---|
| 3,290,716 | 12/1966 | Cain | 15/353 |
| 3,376,597 | 4/1968 | Boyd | 15/320 |
| 3,496,591 | 2/1970 | Sheler | 15/401 X |

*Primary Examiner*—Christopher K. Moore

*Attorney, Agent, or Firm*—Norman P. Friederichs

[57] ABSTRACT

A scrubbing machine is provided including a vacuum squeegee water pickup system. The machine is supported on a pair of drive wheels and a pair of pivotable wheels or casters. The squeegee is drawn by a principal arm and the location of the squeegee is controlled by a steering arm.

9 Claims, 7 Drawing Figures

FIG. I
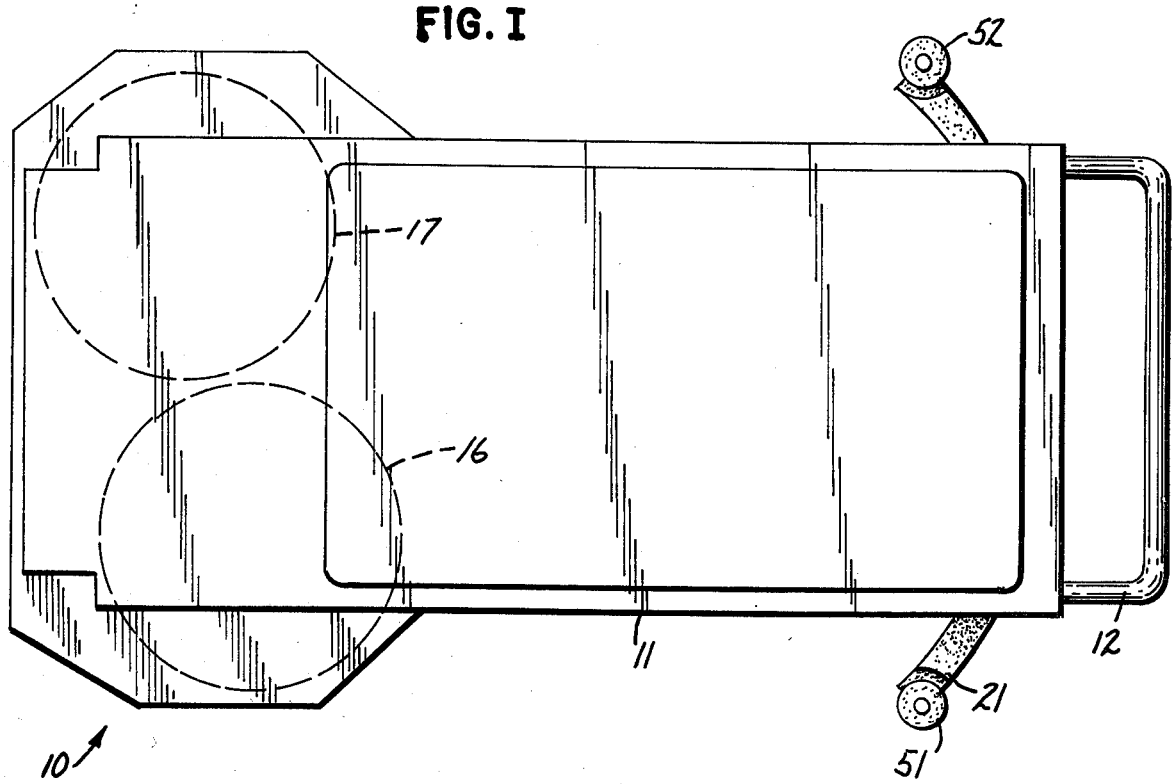
FIG. II
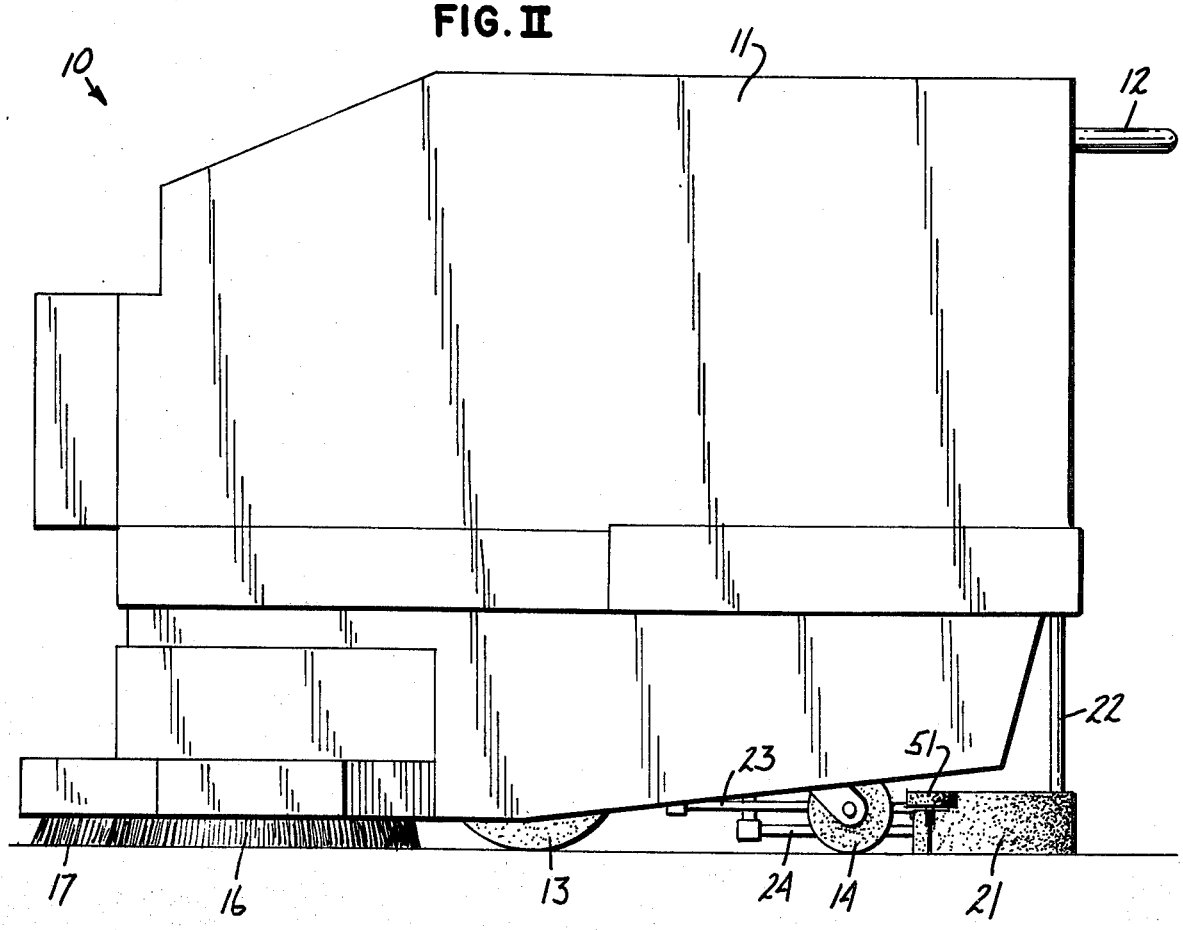

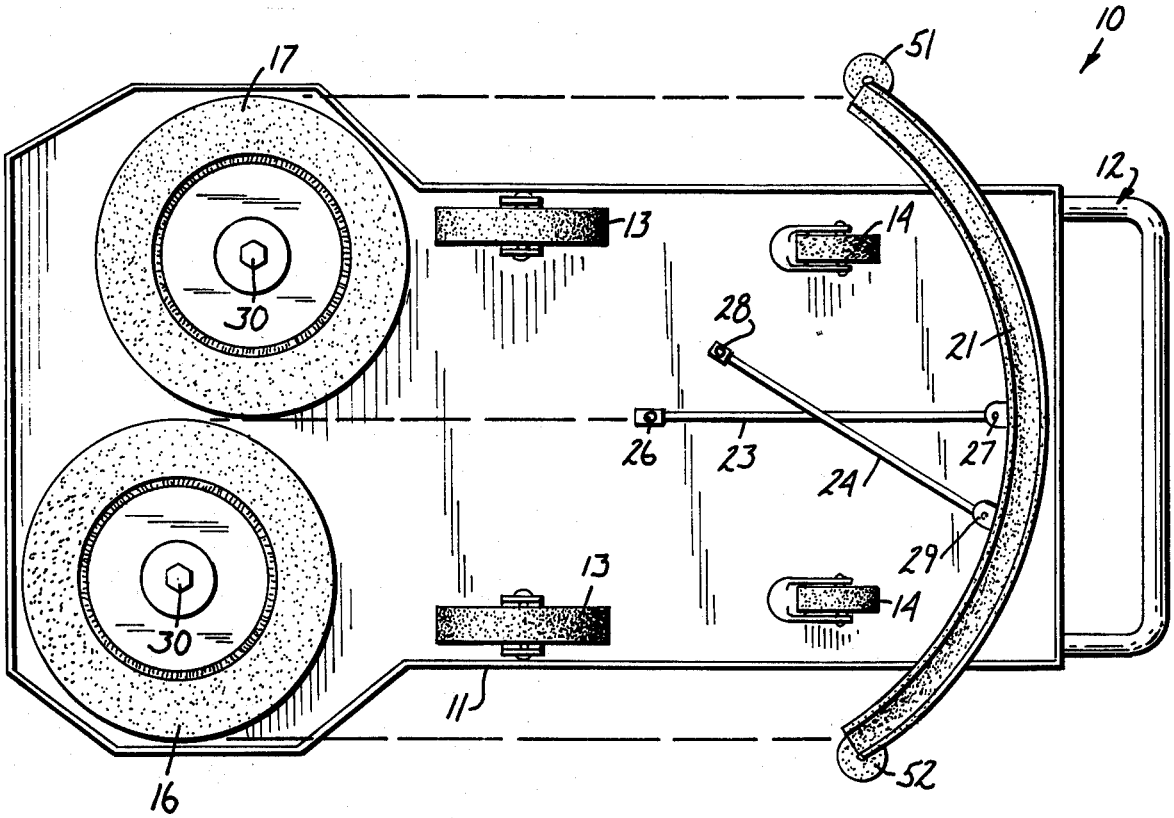
FIG. III
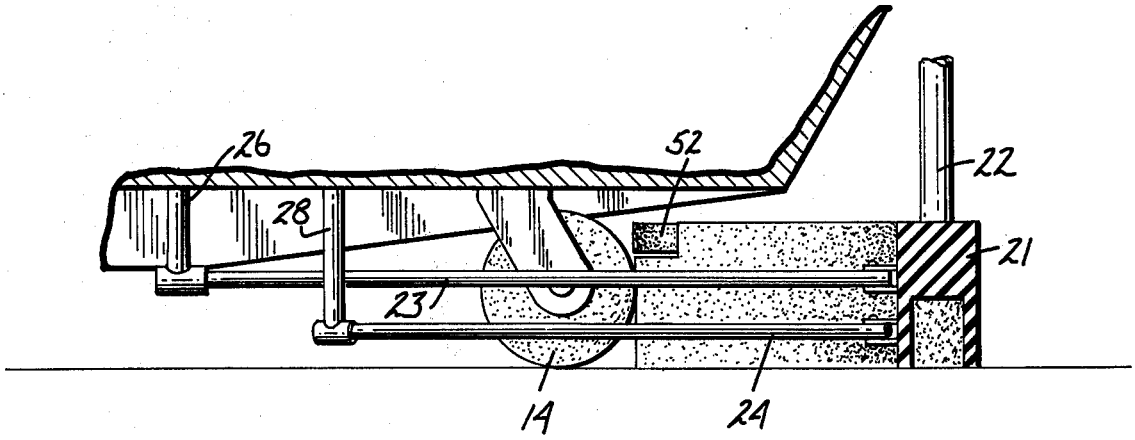
FIG. IV

FIG. V
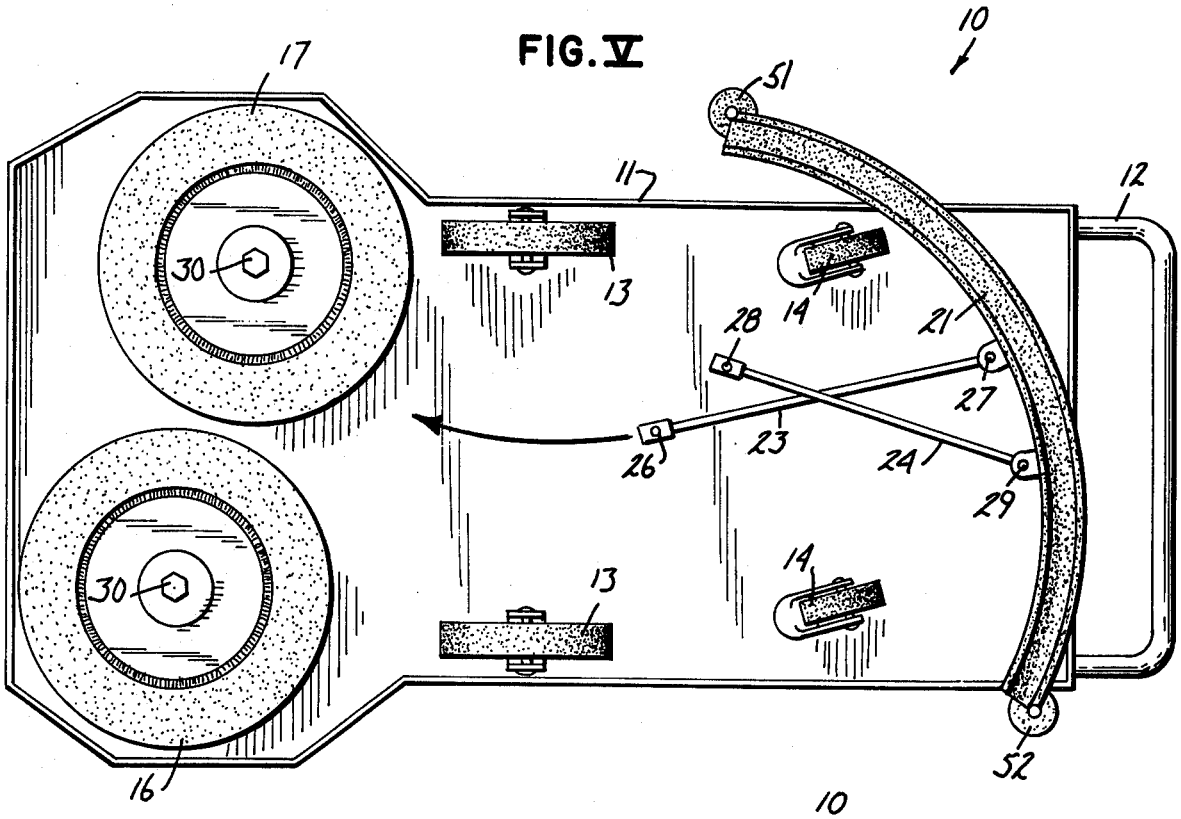
FIG. VI
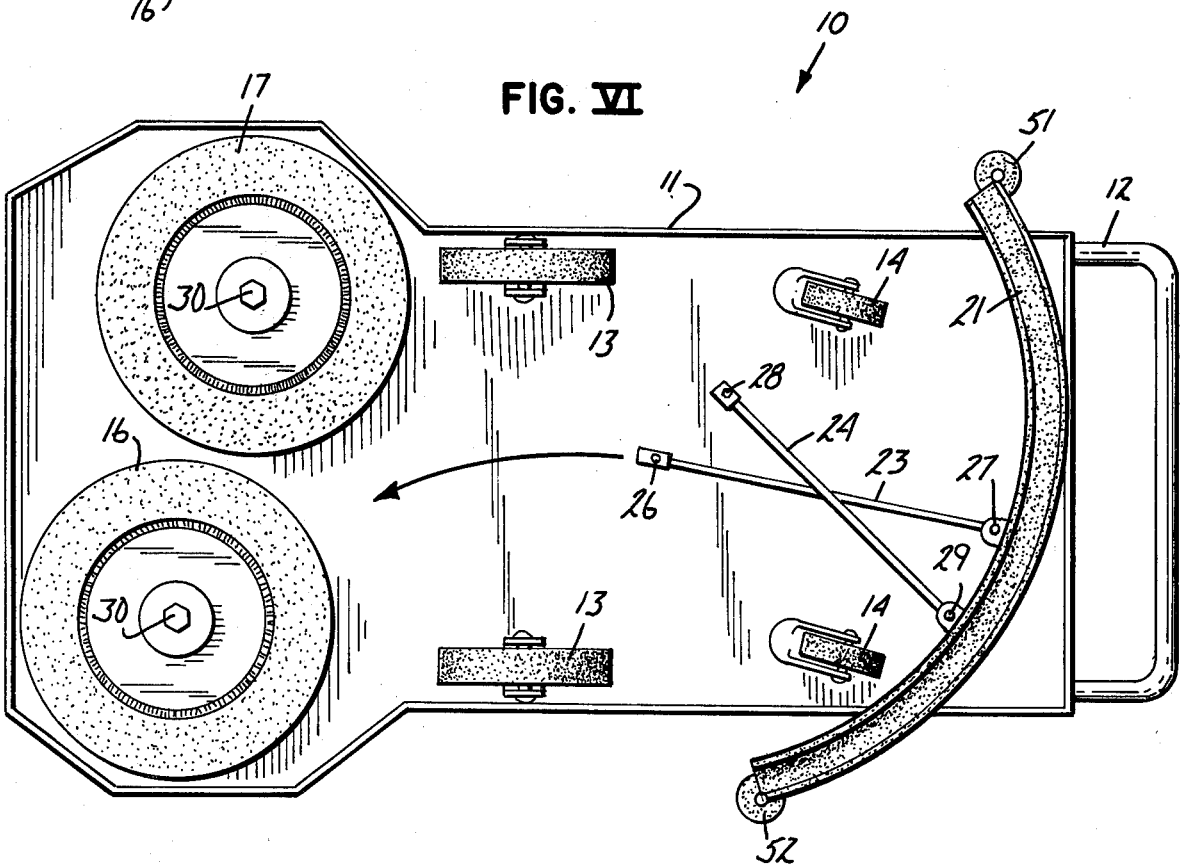

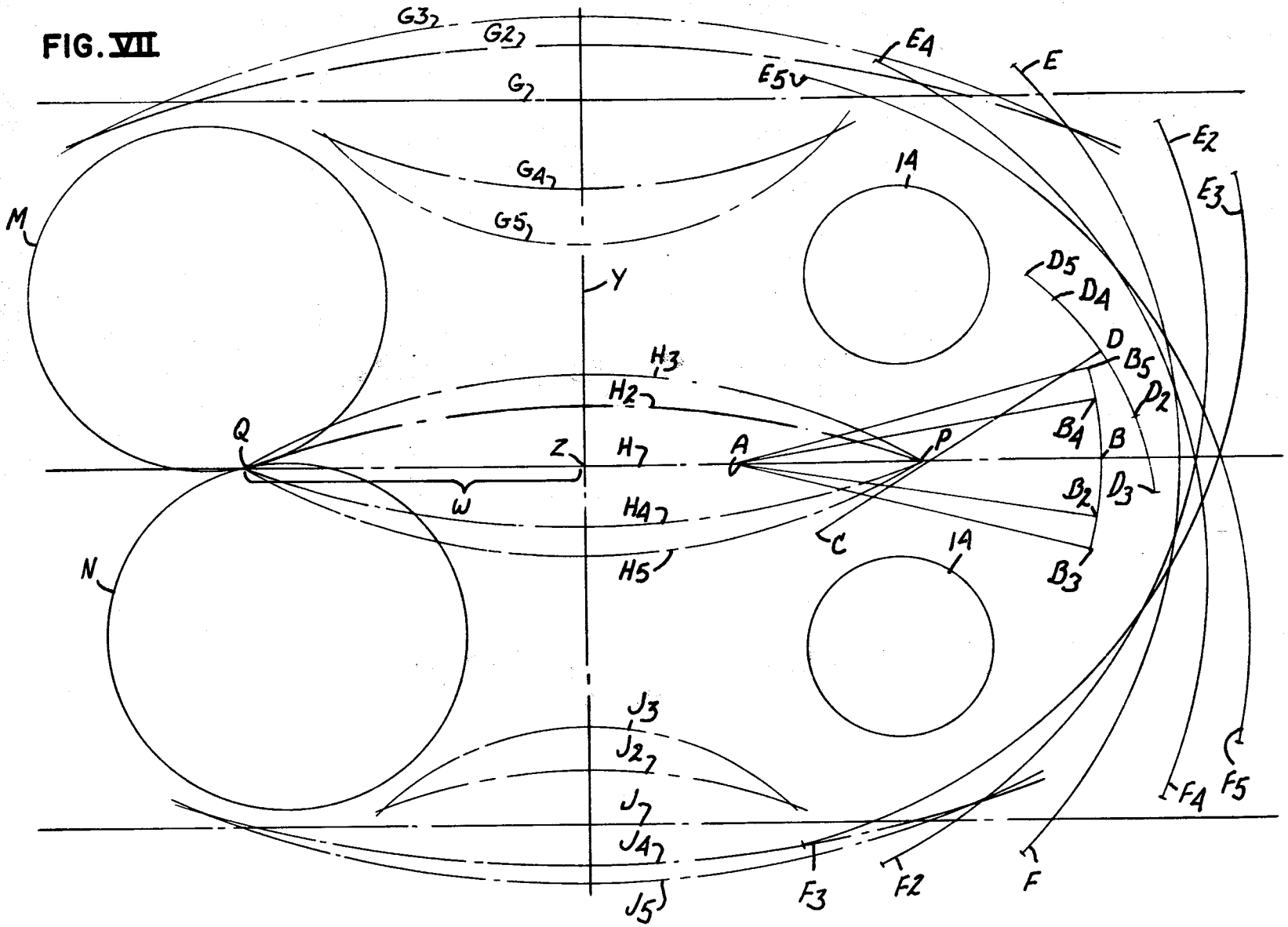
FIG. VII

SCRUBBING MACHINE WITH TRACKING SQUEEGEE

BACKGROUND OF THE INVENTION

The present invention relates to a scrubbing machine and more particularly to a scrubbing machine including a vacuum squeegee.

Scrubbing machines including vacuum squeegees have been known for some time. Such scrubbing machines have generally included a water supply, scrubbing brushes, suitable support wheels and a vacuum system. In some instances, the scrubbing machine has supported the squeegee with the squeegee integrally mounted to the body, thus being locked with respect thereto. In other instances, such as the scrubbing machine shown in U.S. Pat. No. 3,823,791, the squeegee has been drawn by a pivotable pull arm. A common problem has existed in both cases. Specifically the squeegee is shifted out of the wetted pathway whenever the machine makes a turn thus leaving a puddle. Generally the squeegee is locked with respect to the body of the scrubber, the water lay-down portion of the scrubber is forward of the pivot point of the scrubber, and the squeegee is located to the rear of the pivot point of the scrubber. The squeegee moves radially outward as the machine turns, leaving a puddle of water on the radially inward portion of the wetted path. On the other hand, with scrubbers including a pull bar or draw bar, the squeegee tends to shift to the radially inward portion of the wetted path during such a turn, leaving a water puddle on the radially outward portion of the wetted path. This problem can be overcome, at least to a degree, by providing a wetted path of substantially lesser width than the width of the squeegee. Such an arrangement, however, results in other problems. Either efficiency is lost due to a relatively narrow scrubbing path or alternatively the squeegee extends well beyond the sides of the scrubbing machine.

The present invention overcomes the problems inherent in previous scrubbing machines by utilizing a draw bar which is pivotally mounted to the scrubbing machine and a steering arm which controls the location of the squeegee during turns. It has been found that such an arrangement results in good tracking, both when traveling in a straight forward direction as well as when turning on a sharp radius or a more gentle radius.

IN THE DRAWINGS

FIG. I is a top view of a scrubbing machine of the present invention;

FIG. II is a side view of the present scrubber;

FIG. III is a bottom view of the present scrubber showing the draw bar and steering bar arrangement;

FIG. IV shows a side view of such arms;

FIG. V is a bottom view showing the relative positioning of various operative components in the present invention when turning in one direction;

FIG. VI is a bottom view showing the positioning of various operative components when turning in the other direction; and FIG. VII is a schematic view showing the positioning when turning in the various directions.

DETAILED DESCRIPTION OF THE PRESENT INVENTION

The scrubbing machine 10 of the present invention (FIGS. I–III) is shown for purposes of simplicity as a walk-behind model. The scrubbing machine may alternatively be in the form of a riding model. The scrubbing machine 10 may include a body portion 11 including a substructure such as of channel iron, as well as, an outer shell such as of sheet metal. The body portion 11 is shown to include a steering handle 12. The body 11 is supported on a plurality of wheels including drive wheels 13 and pivotable or steerable wheels 14. The drive wheels 13 are suitably connected to an electric motor or to a gasoline engine (not shown) for example by a chain drive.

The scrubbing machine of the present invention may include at least one rotatably driven scrubbing brush for loosening of soilage. Scrubbing machine 10 is illustrated with a pair of disc-shaped bristle brushes which rotate about a vertical axis. The brushes 16 and 17 may be of conventional design and are located forwardly of the drive wheels 13. The scrubbing machine has nozzles 30 near or in the center of each brush for depositing scrubbing solution on the floor forwardly of the brushes. The nozzles may alternatively be located at any point within the brush or at a point forward of the brush.

The scrubbing machine 10 has a vacuum squeegee 21 disposed rearwardly of the wheels 14. The squeegee 21 is connected to a vacuum source (not shown) by a flexible line 22. As shown in FIGS. II–VI, the squeegee 21 is pulled by a draw bar 23 and also includes a steering bar 24. The draw bar 23 may be pivotally attached to the body 11 by pin 26. The other end of draw bar 23 is pivotally attached to the squeegee blade 21 by pin 27. In a similar manner, steering bar 24 is pivotally attached to the body 11 by pin 28 and to squeegee 21 by pin 29. (See FIGS. III and IV.) The draw bar 23, steering bar 24 and wheels 14 must be so located that they do not interfer with each other. A roller such as 51, 52 may be located at either end of the squeegee 21 for purposes hereinafter described.

Although operation of scrubber 10 with squeegee is apparent from the preceding description, it will be further described in order to even more particularly point out the present invention. The operation of the present scrubbing machine 10 in all respects other than the squeegee operation may be of a conventional nature and thus will not be described.

The cleaning machine 10 of the present invention, including the squeegee arrangement, serves to track the wetted area on the floor with the squeegee following such wetted area both in straight forward travel as well as in relatively sharp turns. The vacuum squeegee 21 is pulled or drawn by the bar 23 which may pivot both with respect to the body 11 and the squeegee 21.

The squeegee assembly assumes the position shown in FIG. III when scrubbing machine 10 travels in a straight forward direction. In such position the draw bar 23 may follow the center line of the wetted path. The squeegee blade 21 may extend slightly beyond the edge of the wetted path during scrubbing, such as 1½ inches as well as beyond the sides of the machine 10. The friction between the squeegee 21 and the floor being scrubbed is sufficient that the steering arm 24 does not distort the path traveled by the squeegee 21. At this point, the steering arm only equalizes the forces on the left hand and right hand portions of the squeegee 21. If desired, a detent may be provided which acts on steering arm 24 to resist movement of the arm 24 unless the machine 10 makes a substantial change in direction.

When the scrubbing machine 10 makes a turn, the squeegee 21 inherently moves radially inwardly, for example, as shown in FIGS. V and VI. As the scrubbing machine turns to the left (FIGS. V), the squeegee 21 swings radially inwardly and the steering arm 24 limits the inward movement such that the squeegee follows the wetted path and a puddle does not remain along the radially outward side of the wetted path. During such a turn, a portion of the drawing force is moved from bar 23 to bar 24. The rollers 51 and 52 serve to shift the squeegee 21 sidewardly when the scrubbing machine 10 is operated closely adjacent a wall structure, for example, during a turn. FIG. VI illustrates the relative movements when the scrubbing machine 10 is turned to the right.

FIG. VII is a schematic drawing from above illustrating five wetted paths traversed by the scrubbing machine 10. The schematic drawing illustrates a first path having a centerline H extending in a straight direction. The second path has a centerline $H_2$. This path turns to the left with an inside radius of 40 inches. The third path, with centerline $H_3$, also turns to the left but with an inside radius of 25.5 inches. The fourth path, with centerline $H_4$, turns to the right and has an inside radius of 40 inches. The fifth path, with centerline $H_5$, turns to the right with an inside radius of 25.5 inches.

The various elements of the scrubbing machines are designated in FIG. VII by letters rather than by numerals. For example, the draw bar 23 (FIG. III) is represented by the line A-B in FIG. VII. The pivotal attachment of draw bar 23 to body 11 (FIG. III) is represented by the point A and the attachement of the draw bar 23 to squeegee 21 is represented by the point B (FIG. VII). The steering bar 24 is represented by the line C-D, pivotal attachment to the body is C and pivotal attachment to the squeegee is at D. The right hand tip of the squeegee blade is at E and the left tip is at F. The right hand edge of the wetted floor path is designated G with the left edge being designated J. As previously mentioned, the centerline of the wetted path is along line H.

In the present invention, C must be on one side of the centerline H and D must be on the opposite side of centerline H. The point Q is the midpoint between the centers of the two brushes represented by M and N. The axle of the drive wheel is at line Y and intersects the wetted path centerline at point Z in straight forward travel. Points Q and Z are separated by the distance W. The distance between Z and P is equal to the distance W. In other words, the distance from the center point on centerline of the axle to midpoint between the two brush centers is equal to the distance from the center point on centerline of the axle to the intersection P. The distance from B to P may be equal to the distance from A to P within 5% of the distance W.

The pivot point C may be located in a zone which is defined by a forward edge consisting of a line extending through point A and perpendicular to the straight wetted path centerline. The zone rear edge may be defined by a perpendicular line extending from the straight centerline and located 40% of length of the line AB to the rear of point A. One side edge of the zone follows a line which is parallel with the centerline and spaced from the centerline a distance equal to 10% of the length of the line AB. The other side edge of the zone follows a line which is parallel with the centerline and spaced from the centerline a distance equal to 40% of the length of the line AB. The preferred location for point C is on a line extending from point A which is at an angle of about 45° to the centerline and spaced from point A a distance equal to 30%±10% of the length of the line AB.

The pivot point D is located in a zone which is on the opposite side of the centerline. This zone is defined by a rear edge line perpendicular to the centerline at a point rearward of point B a distance equal to 10% of the length of the line AB. The front edge of the zone is along a line perpendicular to the centerline spaced forwardly of point B a distance equal to 20% of the length of the line AB. One side edge of the zone is parallel to the centerline and spaced from the centerline a distance equal to 15% of the length of the line AB. The other side edge of the zone is also parallel to the centerline and spaced from the centerline a distance equal to 50% of the length of the line AB. The preferred location for point D is on a line extending from point B perpendicular to the centerline and at a distance equal to the distance between points A and C.

The various paths traversed by the scrubbing machine are illustrated by referring to FIG. VII with centerlines $H_2$ to $H_5$, right edges $G_2$ to $G_5$ and left edges $J_2$ to $J_5$. When the scrubbing machine travels around a 40 inch left hand radius, the squeegee shifts from the straight position E-F to the position $E_2$-$F_2$ thus covering the wetted path $J_2$-$G_2$. In this position, the draw bar moves to the A-$B_2$. The steering arm C-D moves to the position C-$D_2$.

The third illustrated path of the scrubbing machine finds the squeegee blade moving to the position $F_3$-$E_3$, the draw bar in position A-$B_3$, and the steering bar at C-$D_3$. In such position, the squeegee blade covers the full wetted path from line $J_3$ to $G_3$.

The fourth path has a squeegee blade in the position $F_4$-$E_4$, the draw bar in position A-$B_4$ and the steering bar in position C-$D_4$. In this position, the squeegee blade covers the full wetted path between line $J_4$ and $G_4$.

The fifth illustrated path has the squeegee in position $F_5$-$E_5$, the draw bar at A-$B_5$ and the steering bar at C-$D_5$. The squeegee blade covers the path between $J_5$ and $G_5$. Of course, the scrubbing machine may follow various other turn radii as desired by the operator with the squeegee blade appropriately following the wetted path.

What is claimed is:

1. A scrubbing machine including a body structure, a plurality of wheels supporting said body, means for depositing scrubbing solution on a surface to be scrubbed thereby providing a wetted path and scrubbing brush means for working said solution on said surface, and vacuum squeegee means for picking up said solution from said surface said squeegee means being disposed rearwardly of said wheels, said squeegee means including draw bar means for pulling said squeegee means along said wetted path and steering bar means for tracking said squeegee means along the wetted path both while traveling along a straight line and when traveling along an arcuate path.

2. The scrubbing machine of claim 1 wherein said draw bar means lies along the centerline of the scrubbing path when said machine moves in a straight line.

3. The scrubbing machine of claim 2 wherein said steering bar means lies at an angular relationship with said draw bar means when said machine moves in a straight line and wherein said steering bar means pushes said squeegee means radially outwardly to follow the scrubbing path when said machine is following an arcuate path.

4. The scrubbing machine of claim 3 wherein said draw bar means includes a pair of ends and wherein one end of said draw bar means is pivotally secured to said body and wherein the other end of said draw bar means is pivotally secured to the squeegee means.

5. The scrubbing machine of claim 4 wherein said steering bar means includes a pair of ends and wherein one end of said steering bar means is pivotally secured to said body at a point to the rear and to the side of said draw bar-body pivot point and wherein the other end of said steering bar means is pivotally secured to the squeegee means.

6. A scrubbing machine including:

a body structure;

front and rear wheel means for movably suporting said body, said front wheel means including an axle;

means for providing a wetted path;

scrubbing brush means for scrubbing a wetted path, said brush means being carried by said body, said brush means being disposed forwardly of said front wheel means;

vacuum squeegee means for picking up scrubbing solution from said wetted path, said squeegee means being carried by said body, said squeegee means being disposed rearwardly of said front wheel means;

drawing bar means for pulling said squeegee means, said drawing bar means having a pair of ends, said drawing bar means being pivotally attached at one end with respect to said body and at the other end to said squeegee means;

steering bar means for steering said squeegee means, said steering bar means having a pair of ends, said steering bar means being pivotally attached at one end with respect said body and at the other end to said squeegee means, said steering bar means one end and said steering bar other end being on opposite sides of said drawing bar means.

7. The scrubbing machine of claim 6 wherein said one end of the drawing bar means is spaced rearwardly of said axle and wherein said one end of the steering bar means is spaced rearwardly of said axle at least as far as the one end of the drawing bar means.

8. The scrubbing machine of claim 7 wherein the pivot point of said one end of the steering bar means is located in a zone, said zone being defined at the forward most edge by a perpendicular line extending from the centerline of the straight wetted path at the pivot point of the one end of said drawing bar; said zone being defined at the rear most edge by a perpendicular line extending from the said centerline at a point located to the rear of the pivot point of the one end of said drawing bar means a distance equal to 40% of the effective length of said drawing bar means; said zone being defined at one side edge by a line parallel with said centerline and spaced from said centerline a distance equal to 10% of the effective length of said drawing bar means; said zone being defined at the other side edge by a line parallel with said centerline and spaced from said centerline a distance equal to 40% of the effective length of said drawing bar means; and wherein the pivot point of said other end of the steering bar means is located in a zone, said zone being defined at the rear most edge by a perpendicular line extending from said centerline at a point rearward of the other end of said drawing bar means a distance equal to 10% of the effective length of the drawing bar means; said zone being defined at the forward most edge by a perpendicular line extending from said centerline at a point forward of the other end of said drawing bar means a distance equal to 20% of the effective length of the drawing bar means; said zone being defined at one edge by a line parallel to said centerline and spaced from said centerline a distance equal to 15% of the effective length of the drawing bar means; and the zone being defined by a line parallel to said centerline and spaced from the centerline a distance equal to 50% of the effective length of the drawing bar means.

9. The scrubbing machine of claim 7 wherein the drawing bar means lies along the centerline of the wetted path when traveling in a straight direction; wherein the pivot point of said one end of the steering bar lies on a line extending from the pivot point of said one end of the drawing bar means, said line being at an angle of about 45° with respect to the wetted path centerline and at a distance equal to 30%±10% of the effective length of the drawing bar means; and wherein the pivot point of the other end of the steering bar means lies on a perpendicular line extending from the straight centerline of the wetted path at the pivot point of the other end of the drawing bar means, the pivot point of the other end of the steering bar means being spaced from said centerline a distance equal to the spacing between said one end of the steering bar means and said one end of the drawing bar means.

* * * * *